US005406238A

United States Patent [19]

Suzuki

[11] Patent Number: 5,406,238

[45] Date of Patent: Apr. 11, 1995

[54] RING RESONATOR DEVICE

[75] Inventor: Hiroshi Suzuki, Kawasaki, Japan

[73] Assignee: Fujitsu Limited, Kawasaki, Japan

[21] Appl. No.: 942,809

[22] Filed: Sep. 10, 1992

[30] Foreign Application Priority Data

Sep. 10, 1991 [JP] Japan ..... 3-230554

[51] Int. Cl.[6] ..... H01P 7/08

[52] U.S. Cl. ..... 333/219; 333/235

[58] Field of Search ..... 333/204, 205, 219, 235; 331/99, 107 SL, 96

[56] References Cited

U.S. PATENT DOCUMENTS

| | | | |
|---|---|---|---|
| 3,678,433 | 7/1972 | Hallford | 333/204 |
| 4,121,182 | 10/1978 | Makimoto et al. | 333/205 |
| 4,264,881 | 4/1981 | De Ronde | 333/204 X |
| 4,333,062 | 6/1982 | Uwano | 331/176 X |
| 4,641,116 | 2/1987 | Shibata et al. | 333/219 X |
| 4,749,963 | 6/1988 | Makimoto et al. | 331/117 D X |
| 5,055,809 | 10/1991 | Sagawa et al. | 333/219 |
| 5,187,460 | 2/1993 | Forterre et al. | 333/219 |

FOREIGN PATENT DOCUMENTS

| | | |
|---|---|---|
| 0127527 | 12/1984 | European Pat. Off. . |
| 52-104033 | 9/1977 | Japan . |

OTHER PUBLICATIONS

M. Makimoto, "Microstrip-Line Split-Ring Resonator and Their Application to Bandpass Filters," Electronics and Communications in Japan, Part 2, vol. 72, No. 5, May 1989, New York, N.Y., pp. 104–112.

*Primary Examiner*—Seungsook Ham
*Attorney, Agent, or Firm*—Staas & Halsey

[57] ABSTRACT

A ring resonator device comprises a dielectric substrate, a back-grounded conductor attached to the dielectric substrate therebeneath, a ring-shaped conductor strip, provided on the dielectric substrate, for forming an inductance element, and a capacitive element unit provided on the dielectric substrate, for forming a capacitance element. The capacitive element unit includes a plurality of capacitive elements and the capacitive elements are arranged in a distributed way so as to be laid across both opposed sides of the ring-shaped conductor strip.

6 Claims, 7 Drawing Sheets

RING RESONATOR DEVICE

BACKGROUND OF THE INVENTION

1. Field of the Invention

The present invention relates to a ring resonator device, and more particularly to a ring resonator device which is formed by a ring-shaped conductive strip and a capacitive element on a dielectric substrate having a back-grounded conductor.

2. Description of the Related Art

In general, a ring resonator is used for an oscillator in a semi-microwave band such as in a portable telephone, an automotive telephone, a clock for optical communication, or the like, due to its low price. At present, more miniaturization or down-sizing is required for these devices or equipment and therefore, it is also required to make these devices smaller in size.

In the prior art, it is necessary to increase the total length of a ring-shaped conductive strip in a ring resonator having a low resonance frequency. Therefore, the area that a ring resonator occupies is conventionally wide and the equipment containing the ring resonator is large in size and heavy.

SUMMARY OF THE INVENTION

An object of the present invention is to provide a small-sized ring resonator.

In accordance with an aspect of the present invention, there is provided a ring resonator device formed by a ring-shaped conductive strip and a capacitive element on a dielectric substrate having a back-grounded conductor wherein a plurality of capacitive elements are installed dispersedly so as to be laid across both opposed sides of said ring-shaped conductor strip.

DESCRIPTION OF THE PREFERRED EMBODIMENTS

An embodiment of the present invention will be described in detail with reference to the prior art.

Figure 1:
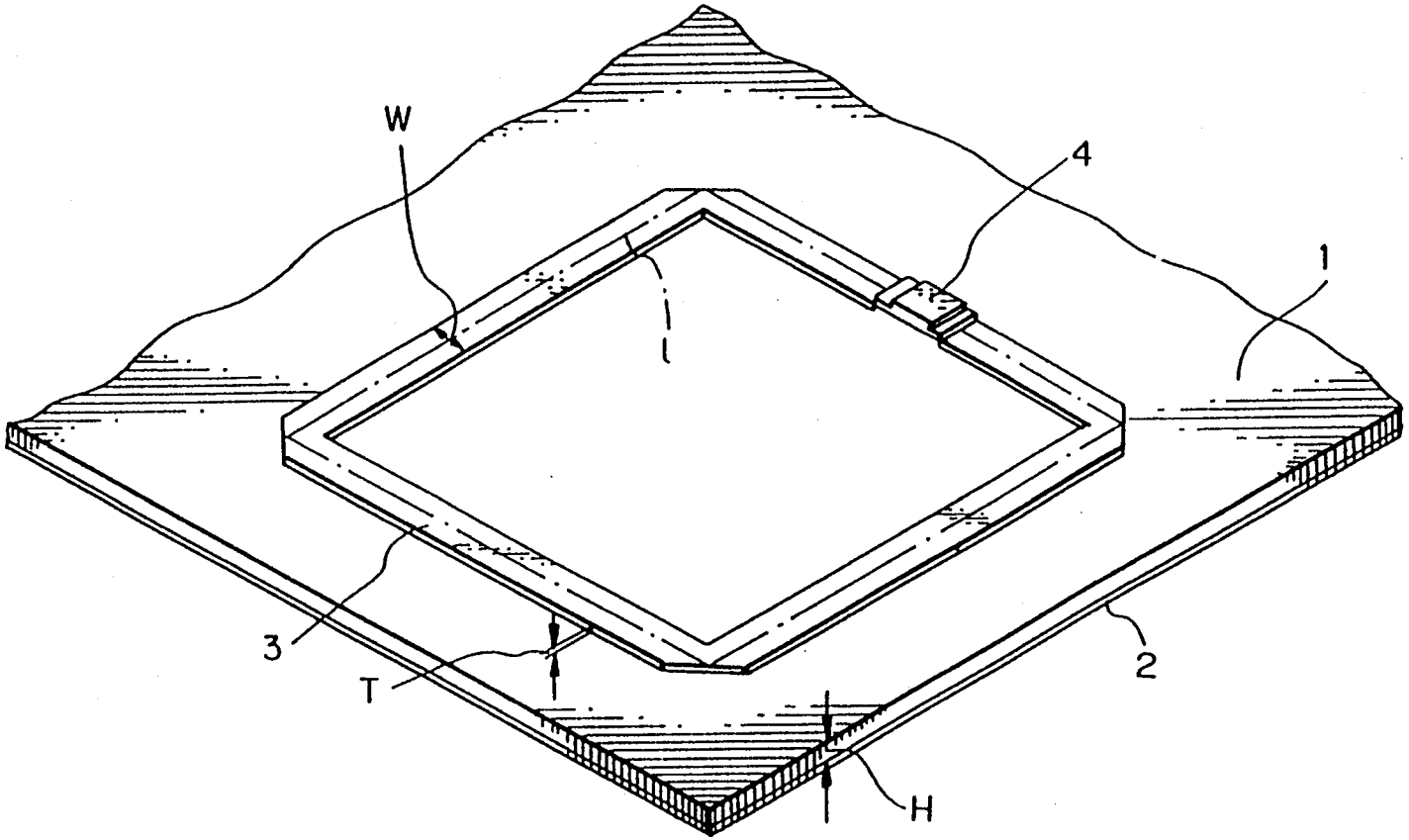
Fig. 1 PRIOR ART
FIG. 1 is a view showing the configuration of a prior art ring resonator.

FIG. 1 is a view showing the configuration of a prior art ring resonator.

In FIG. 1, reference numeral 1 denotes a dielectric substrate of glass epoxy resin, 2 a back-grounded conductor, 3 a ring-shaped conductive strip, and 4 a component capacitor.

A conventional ring resonator is formed by a ring-shaped conductive strip 3 and a component capacitor 4. Assuming that a capacitance of the capacitor 4 is C and an inductance of the conductive strip 3 is L, a resonant frequency $f_0$ of the ring resonator is substantially given by an expression $f_0=\frac{1}{2}\pi(LC)^{\frac{1}{2}}$. Therefore, if the resonant frequency $f_0$ is low, a large value of C or L is necessary, but since a large value of C with good frequency characteristics is difficult to obtain, L is made large. To obtain a resonant frequency $f_0=663$ MHz with the ring resonator of this example, on the condition that H=0.8 mm, T=0.035 mm, W=3.0 mm and C=2 pF, a conductive strip 3 has an overall length l of 77.6 mm. It is necessary for a prior art ring resonator to increase the total length l of the ring-shaped conductive strip 3. For this reason, the area occupied by the ring resonator must necessarily be enlarged.

Figure 2A:
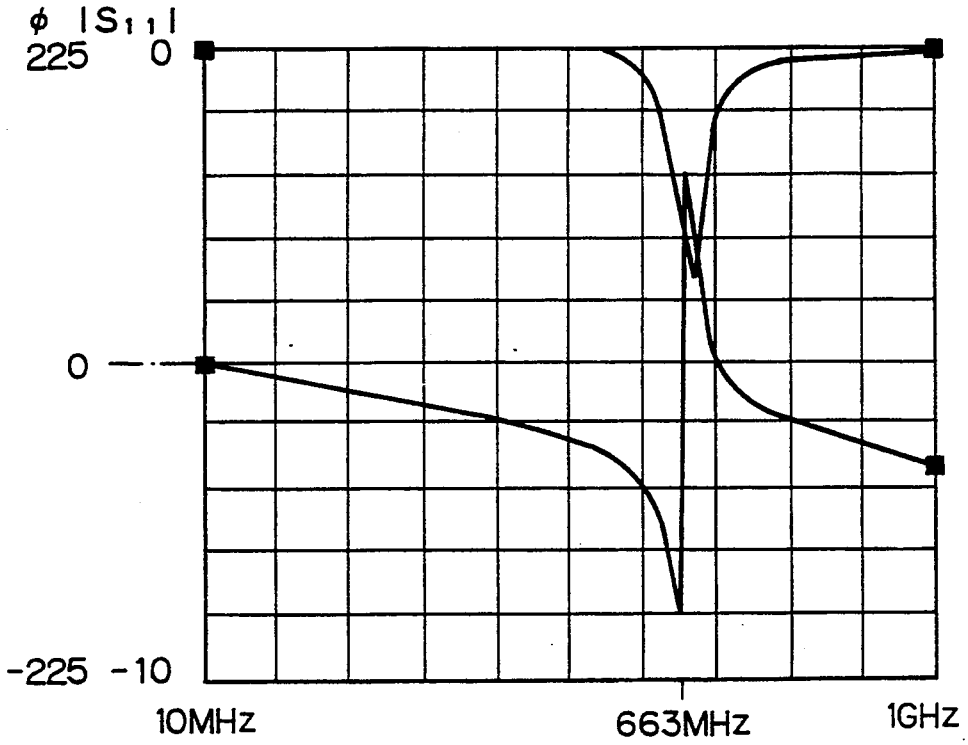
FIG. 2(A) illustrates frequency characteristics of an absolute value of a reflection coefficient and a phase relationship.
Figure 2B:
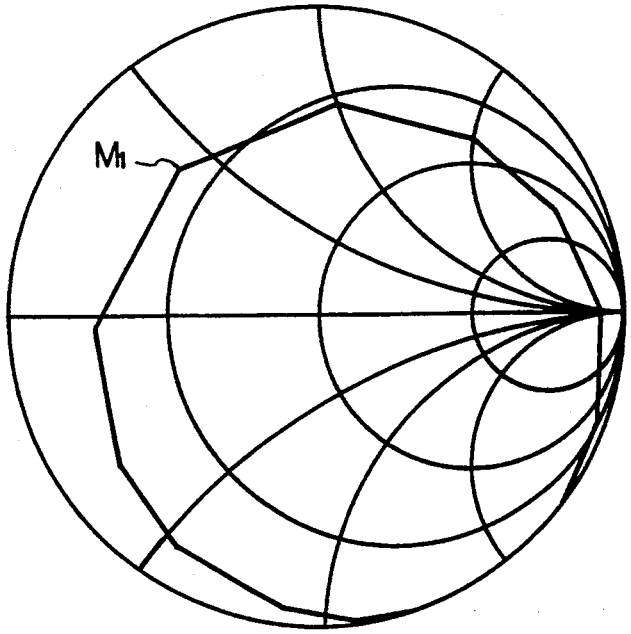
FIG. 2(B) illustrates frequency characteristics of a reflection coefficient on a Smith chart.

FIG. 2 is a view showing a resonance curve of a prior art ring resonator. FIG. 2(A) illustrates frequency characteristics of an absolute value $|S_{11}|$ of a reflection coefficient and a phase $\phi$, and FIG. 2(B) shows frequency characteristics of a reflection coefficient $S_{11}$ on a Smith chart. In FIG. 2(A), a reflection coefficient $|S_{11}|$ is nearly −3.5 dB and a phase $\phi$ is nearly 135 degrees at a resonant frequency $f_0=663$ MHz.

FIG. 2(B) is a frequency characteristics curve in which vectors of the reflection coefficient $S_{11}$ are plotted at intervals of a predetermined frequency with each resulting point connected to produce a polygonal line graph. Reference $M_1$ in FIG. 2(B) denotes a reflection coefficient at a resonant frequency $f_0=663$ MHz. As described above, since a polygonal line graph is plotted at intervals of a predetermined frequency, the longer the length of each polygonal line is in the vicinity of the resonant frequency $f_0=663$ MHz, the more abrupt a phase change per unit frequency is, that is, the larger the value of Q in the resonant circuit is.

As described above, a prior art ring resonator is formed by a ring-shaped conductive strip 3 and a component capacitor 4. Therefore, it is necessary to increase the total length 1 of the conductive strip 3 in a low resonance frequency region. Therefore, it is disadvantageous in that an area occupied by the ring resonator becomes considerably large and heavy.

The present invention is directed to solving such drawbacks to provide a ring resonator more appropriate for practical use.

Figure 3:
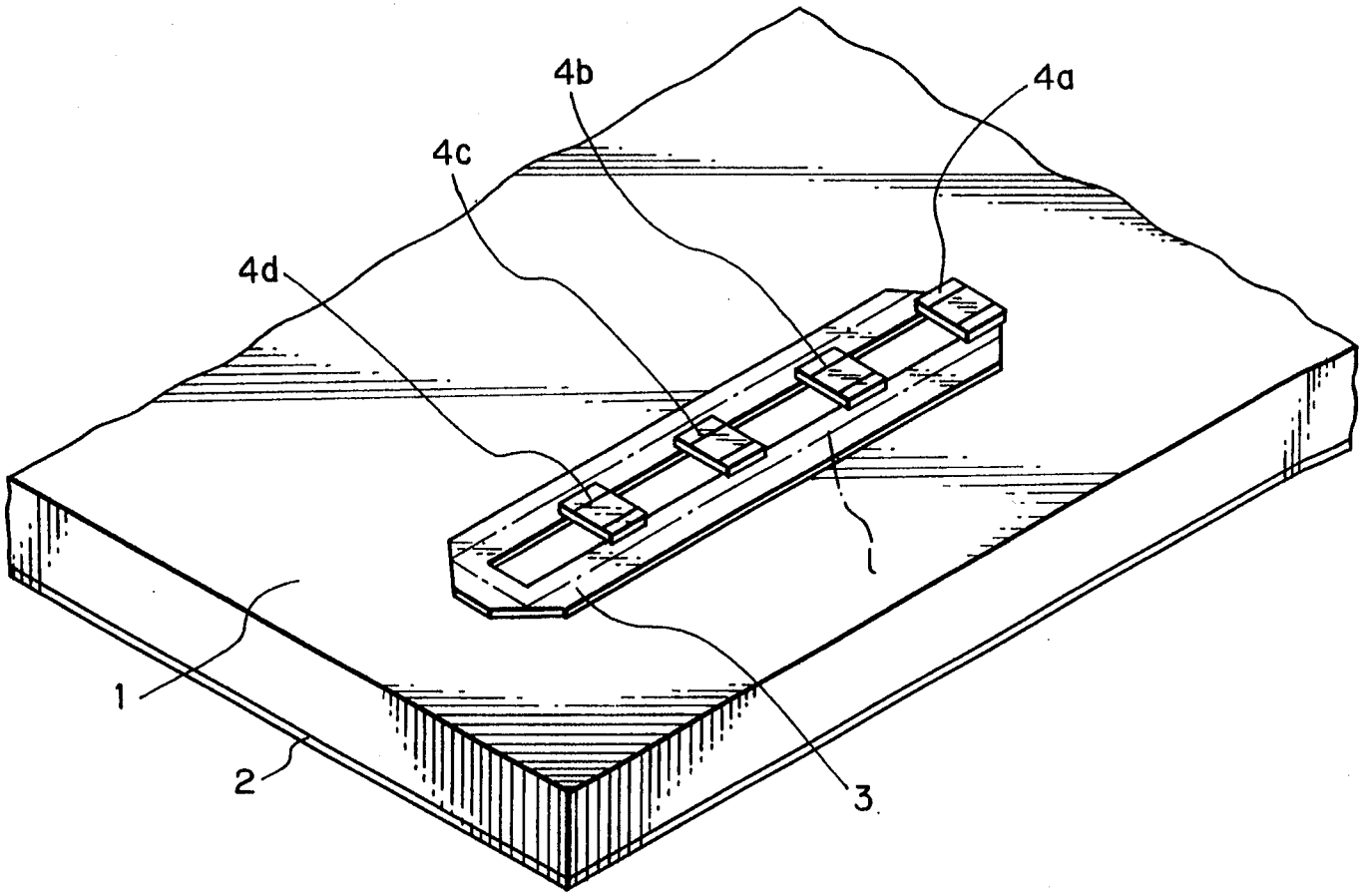
FIG. 3 is a perspective view showing an outlined structure in accordance with the present invention.

FIG. 3 is a perspective view showing an embodiment in accordance with the present invention.

Figure 4:
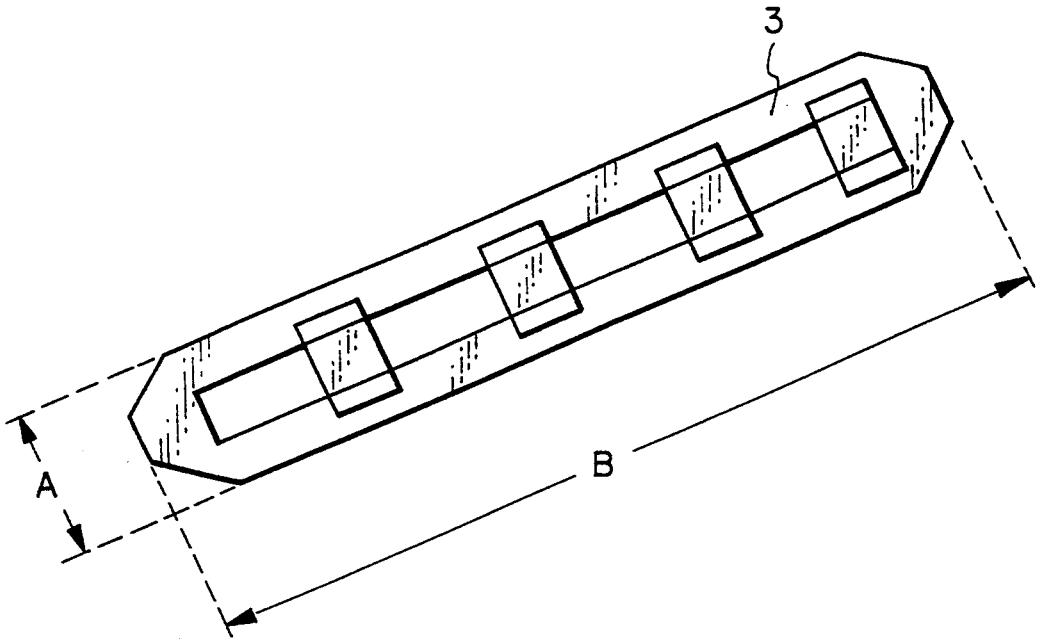
FIG. 4 is a schematic diagram showing an aspect ratio of a ring shaped conductor strip in FIG. 3.

In FIG. 3, a ring resonator of the present invention is formed by a ring-shaped conductive strip 3 and a capacitive element unit both provided locally on a dielectric substrate 1 having a back-grounded conductor 2 attached to the substrate 1 underneath. The capacitive element unit is formed by a plurality of capacitive elements 4*a* to 4*d* which are laid across both opposed sides of the ring-shaped conductor strips 3. The number of capacitive elements may be selected appropriately in proportion to a desired capacitance value. The size of the ring-shaped conductor strip 3, that is, the aspect ratio A/B may be selected arbitrarily according to need or design requirements as shown in FIG. 4.

Further, since a plurality of capacitive elements 4*a* to 4*d* are installed dispersedly or in a distributed way, even if the capacitance of each individual capacitive element is small, the combined capacitance of these elements can grow large. Therefore, in the case of a low resonance frequency, it is not necessary to increase the total length of the conductor strip 13, moreover, the total length can be shortened compared with a prior art device. However, in the case of a high resonance frequency, a total length L of the conductor strip 13 can be lengthened, for example, by a lamination of the conductor strips.

Figure 5:
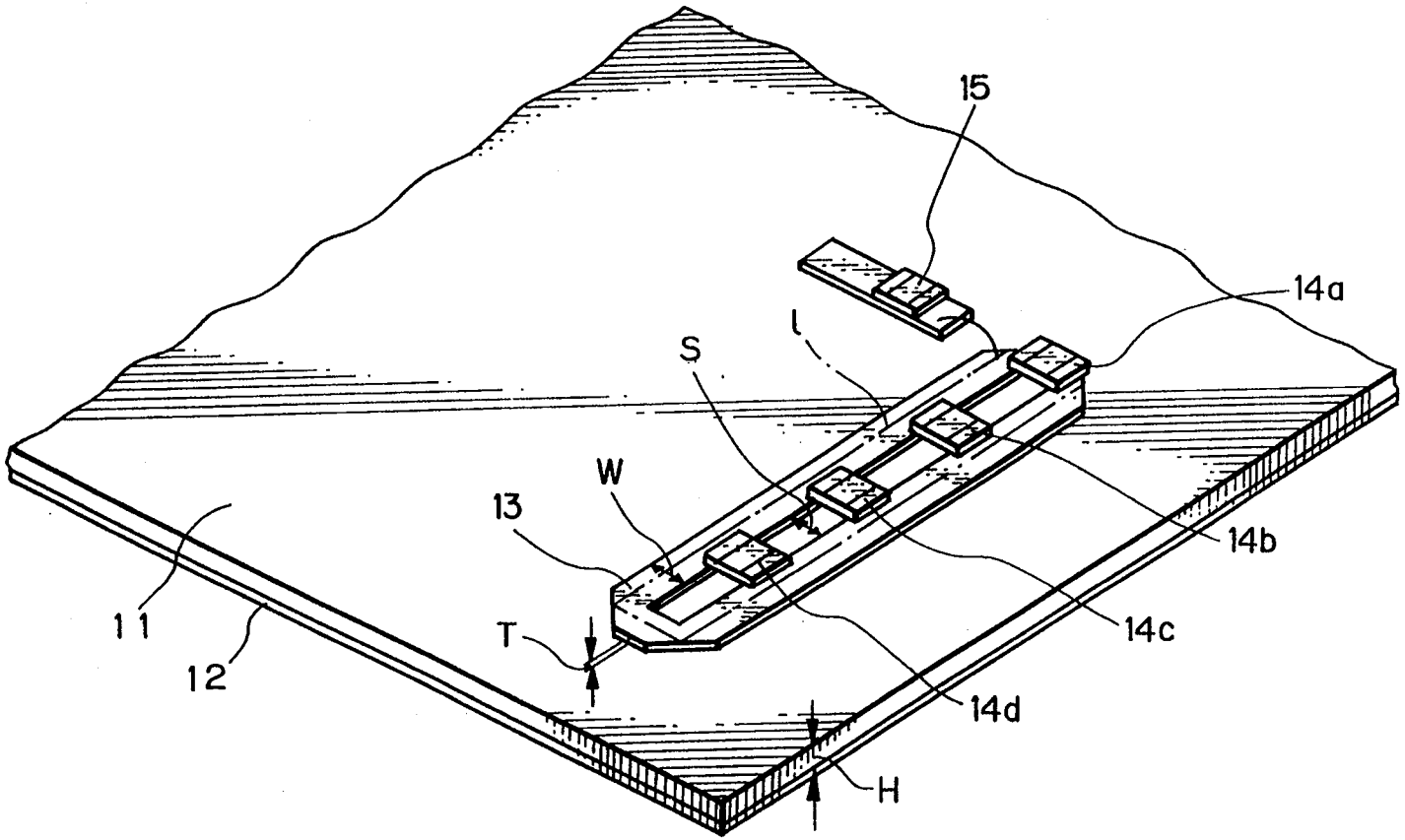
FIG. 5 is a perspective view showing the configuration of an embodiment of the present invention.

FIG. 5 is a perspective view showing the configuration of an embodiment of the present invention. In FIG. 5, reference numeral 11 denotes a dielectric substrate of glass epoxy resin, 12 a back-grounded conductor, 13 a ring-shaped conductor strip, 14*a* to 14*d* a component capacitor, and 15 a coupling capacitor with other circuits.

In the embodiment of FIG. 5, on the condition that a thickness of a substrate 11 H=0.8 mm, a thickness of a ring-shaped conductor strip T=0.035 mm, a width of the conductor strip W=3.0 mm, an internal interval of the conductor strip S=more than 1.0 mm, and each capacitance Ca to Cd of each capacitor 14*a* to 14*d*=2 pF, in order to obtain the same resonant frequency $f_0$=663 MHz as in a prior art, a total length l of the conductor strip 13 is given as l=55.2 mm, which is reduced to about seventy percent of the embodiment in FIG. 1.

Figure 6A:
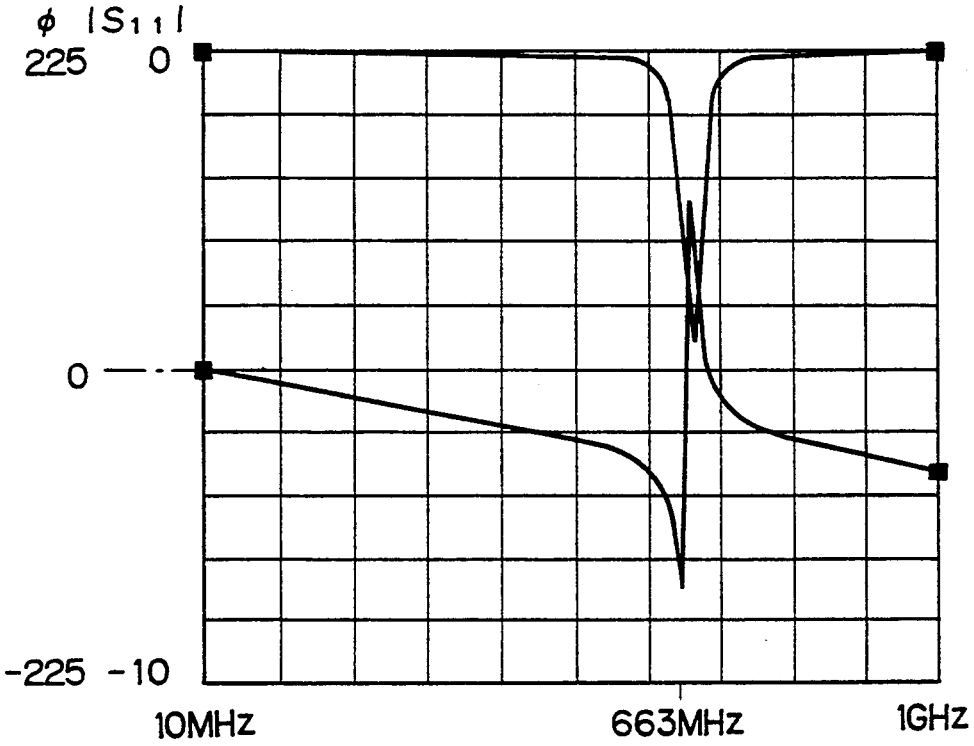
FIG. 6(A) is a view showing frequency characteristics of an absolute value of a reflection coefficient and a phase relationship.
Figure 6B:
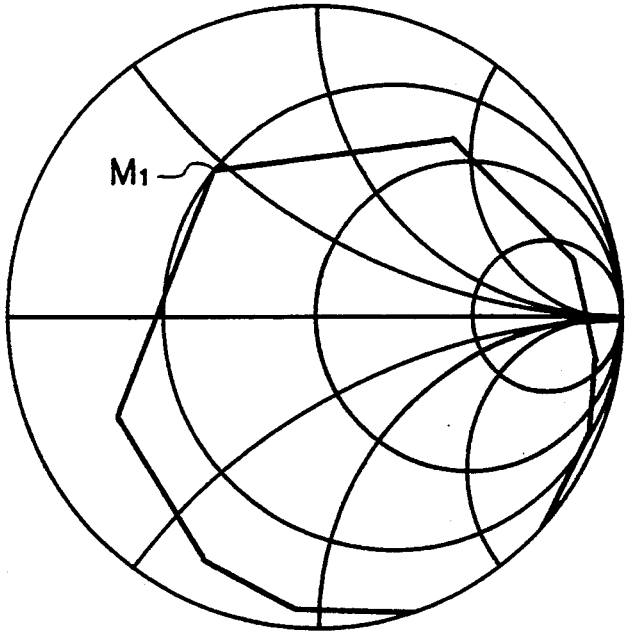
FIG. 6(B) is a view showing frequency characteristics of reflection coefficient on a Smith chart.

FIGS. 6(A) and 6(B) are views showing a resonance characteristic of a ring resonator of the embodiment in FIG. 5. FIG. 6(A) is a view showing frequency characteristics of an absolute value $|S_{11}|$ of a reflection coefficient and a phase $\phi$, and FIG. 6(B) is a view showing frequency characteristics of reflection coefficient $S_{11}$ on a Smith chart.

In FIG. 6(A), the reflection coefficient $S_{11}$ in the resonance frequency $f_0$=663 MHz is nearly −4.6 dB, and a phase angle $\phi$ is about 128 degrees.

In FIG. 6(B), a vector of reflection coefficient $S_{11}$ is plotted by intervals of the same predetermined frequency as in FIG. 2(B) and the results are combined in a polygonal line graph. In the figure, $M_1$ denotes a reflection coefficient $S_{11}$ at the resonant frequency $f_0$=663 MHz. Comparing the length of each polygonal line near the resonant frequency $f_0$=663 MHz with those in a prior art shown in FIG. 2(B), a length in FIG. 5(B) of the present embodiment is especially long. That is, it is apparent that a value of Q in a resonant circuit of the present embodiment is larger. Since a total length l of the conductor strip 13 is reduced, conduction loss and dielectric loss or the like are mitigated.

In accordance with the embodiment of the present invention, since a composite capacitance of a plurality of capacitors 4*a* to 4*d* has an effect on the resonant frequency $f_0$, even if a temperature characteristic or the like of each capacitor is random, it is advantageous that each random value is averaged as a whole. Further, if capacitors having different temperature characteristics are combined, it is possible to attain a desired temperature characteristic.

Figure 7:
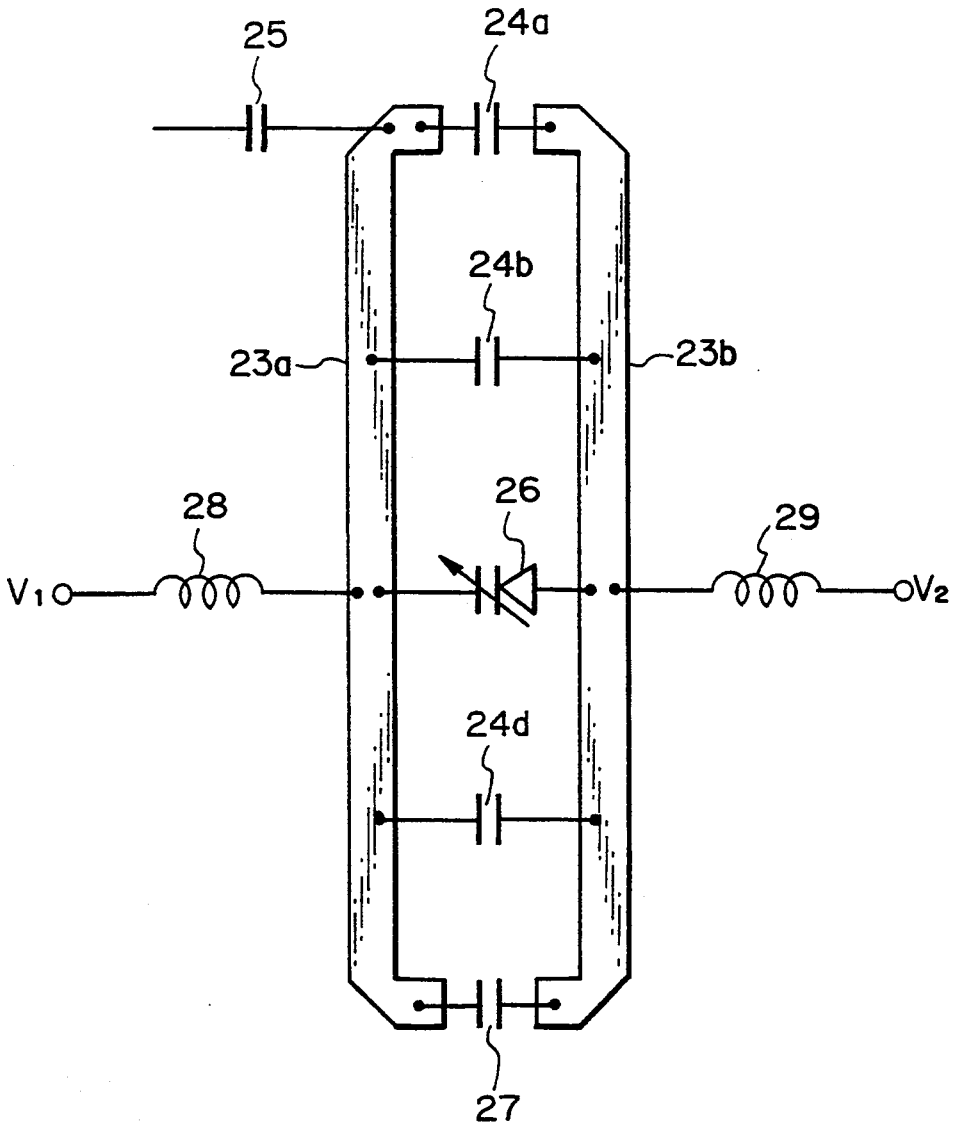
FIG. 7 is a view showing the configuration of another embodiment of the present invention.

FIG. 7 is a view showing the configuration of another embodiment of the present invention. In FIG. 7, reference numerals 23*a* and 23*b* denote opposed sides of a ring-shaped conductor strip 23, 26 denotes a varactor diode, 27 a component capacitor of adequate capacitance (for example, 1000 pF) in comparison with a resonant frequency $f_0$, and 28 and 29 are bias feed coils.

In FIG. 7, it is preferable that the space between both opposed sides 23*a* and 23*b* of the ring-shaped conductor strip is cut away and the cut-away-part is coupled with a large capacitance of capacitive element 27 in comparison with the resonance frequency $f_0$ and concurrently, any one of a plurality of capacitive elements 24*a* to 24*d* is substituted by a varactor diode 26 the capacitance of which is variable.

In light of the resonant frequency $f_0$, since a capacitor 27 appears as a short circuit, this is the same as in the case where one ring-shaped conductor strip 3, 13 is provided. On the other hand, in light of a control voltage of a voltage-controlled oscillator or a low frequency signal for frequency modulation, a location between sides 23*a* and 23*b* is isolated, a control voltage of the voltage-controlled oscillator VCO or a signal V1 for frequency modulation can be applied to the side point 23*a* and a ground potential or a definite bias voltage V2 is applied to the side point 23*b*. Therefore, based on the signal V1 for frequency modulation, a capacitance of the varactor diode 26 changes and the resonant frequency $f_0$ of the ring resonator can also be modified.

In this case, the influence that a change of capacitance has effect on the resonant frequency $f_0$ grows smaller in order of the positions of capacitors 24*a*, 24*b* and 24*d*. For example, providing for a varactor diode 26 to which an application of 1 V produces a change of 0.5 pF, when the varactor diode 26 is used at each position of capacitors 24*a*, 24*b* or 24*d*, when a change of resonant frequency $f_0$ is measured after a capacitance of the varactor diode 26 is changed by 0.5 pF, a respective modulation sensitivity of 30 MHz/V, 12 MHz/V and 3 MHz/V is obtained at each position of capacitors 24*a*, 24*b* and 24*d*. Therefore, in accordance with the current embodiment of the present invention, a desired modulation sensitivity is obtained according to an installed position of a varactor diode 26.

In this embodiment, four capacitors 4*a* to 4*d* are used, but an arbitrary number of capacitors may be selected.

In accordance with the present invention, since a plurality of capacitive elements 14*a* to 14*d*, and 24*a* to 24*d*, are installed dispersedly to be laid across the opposed sides of a ring-shaped conductor strip 13, 23, a total length l of the ring-shaped conductor strip 13, 23 can be shortened and the size of the ring resonator is reduced. Further, a desired modulation sensitivity is obtained according to the installed positions of the varactor diode 26.

I claim:

1. A ring resonator device, comprising:

a dielectric substrate;

a back-grounded conductor attached to said dielectric substrate therebeneath;

a ring-shaped conductor strip, provided on said dielectric substrate, forming an inductance element and having at least a first side having ends and a second side parallel to the first side and having ends corresponding to the ends of the first side, forming corresponding ends; and a capacitive element unit provided on said dielectric substrate, forming a capacitance element, said capacitive element unit including a plurality of capacitive elements, said capacitive elements are arranged in a distributed way so as to be laid between said first side and said second side, and further said capacitive elements are placed at positions between the corresponding ends.

2. A ring resonator device according to claim 1, wherein a respective space between the corresponding ends is cut out forming cut-out portions, one of said cut-out portions is coupled with one of the plurality of capacitive elements having an adequately large capacitance to provide a resonant frequency, and another of said plurality of capacitive elements is a varactor diode forming a variable capacitance.

3. A device according to claim 2, wherein a frequency modulating signal is applied to said varactor diode changing the resonant frequency of said ring resonator device.

4. A device according to claim 2, wherein said varactor diode is installed at a first position, producing a first desired modulation sensitivity.

5. A ring resonator device according to claim 1, wherein separate temperature characteristics of at least two capacitive elements of said plurality of capacitive elements are different from each other, and the ring resonator device is constructed to have a predetermined temperature characteristic.

6. A ring resonator device comprising:

a dielectric substrate;

a back-grounded conductor attached to said dielectric substrate;

an enclosed ring-shaped conductor strip, provided on said dielectric substrate, forming an inductance element and having an inner perimeter, said inner perimeter comprising a first side and a second side parallel to said first side; and capacitive element units connected to said first side and to said second side.

* * * * *

UNITED STATES PATENT AND TRADEMARK OFFICE

CERTIFICATE OF CORRECTION

PATENT NO. : 5,406,238

DATED : April 11, 1995

INVENTOR(S) : Hiroshi SUZUKI

It is certified that error appears in the above-indentified patent and that said Letters Patent is hereby corrected as shown below:

Column 3, line 1, change ", moreover" to --. Moreover--.

Signed and Sealed this

Thirteenth Day of June, 1995

*Attest:*

Bruce Lehman

BRUCE LEHMAN

*Attesting Officer*

*Commissioner of Patents and Trademarks*